US009461429B2

(12) United States Patent
Wu et al.

(10) Patent No.: US 9,461,429 B2
(45) Date of Patent: Oct. 4, 2016

(54) ELECTRICAL CONNECTOR ASSEMBLY HAVING EXTRA SIGNAL CONTACT

(71) Applicant: FOXCONN INTERCONNECT TECHNOLOGY LIMITED, Grand Cayman (KY)

(72) Inventors: Jerry Wu, Irvine, CA (US); Jun Chen, Kunshan (CN); Fan-Bo Meng, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/583,746

(22) Filed: Dec. 28, 2014

(65) Prior Publication Data

US 2015/0188262 A1 Jul. 2, 2015

(30) Foreign Application Priority Data

Dec. 30, 2013 (CN) ..... 2013 1 0741050
Dec. 30, 2013 (CN) ..... 2013 1 0741084

(51) Int. Cl.
*H01R 13/6593* (2011.01)
*H01R 27/02* (2006.01)
*H01R 24/62* (2011.01)

(52) U.S. Cl.
CPC ..... *H01R 27/02* (2013.01); *H01R 13/6593* (2013.01); *H01R 24/62* (2013.01)

(58) Field of Classification Search
CPC ..... H01R 13/6593; H01R 27/02
USPC ..... 439/660, 701, 607.55, 607
See application file for complete search history.

(56) References Cited

U.S. PATENT DOCUMENTS 7,467,977 B1 12/2008 Yi et al.
7,559,805 B1 7/2009 Yi et al.
7,625,243 B2 * 12/2009 Chen ..... H01R 23/6873 439/541.5
7,654,871 B2 * 2/2010 Yi ..... H01R 13/6658 439/660
7,955,132 B2 * 6/2011 Luo ..... H01R 12/62 439/607.41
8,202,119 B2 6/2012 Zhang
8,821,186 B2 * 9/2014 Lan ..... H01R 13/514 439/540.1
2010/0093217 A1 * 4/2010 Shi ..... H01R 13/6581 439/607.41
2011/0034080 A1 * 2/2011 Su ..... H01R 27/00 439/607.01
2011/0250783 A1 * 10/2011 Su ..... H01R 4/2433 439/404
2011/0269341 A1 * 11/2011 He ..... H01R 24/60 439/607.01
2012/0064769 A1 * 3/2012 Su ..... H01R 13/6581 439/607.55
2012/0164875 A1 * 6/2012 Su ..... H01R 13/7175 439/490
2014/0308848 A1 * 10/2014 Shi ..... H01R 24/62 439/607.55
2014/0349523 A1 * 11/2014 Peng ..... H01R 13/6593 439/701
2015/0056839 A1 * 2/2015 Zhang ..... H01R 13/6581 439/350

* cited by examiner

*Primary Examiner* — Tulsidas C Patel
*Assistant Examiner* — Marcus Harcum
(74) *Attorney, Agent, or Firm* — Wei Te Chung; Ming Chieh Chang

(57) ABSTRACT

An electrical connector assembly (100) comprises an insulative housing (1) comprising a lower wall, a receiving space (110), a cavity (120) above the receiving space (110), a shielding shell (9) enclosing the insulative housing (1), a number of contacts (2, 3) received in the insulative housing (1) and a cable (5). The contacts (2, 3) comprise a number of first contacts (2) for transmitting USB 3.0 signal and a number of second contacts (3) capable of transmitting USB 2.0 signal, and an extra signal contact (3*e*) transmitting an extra signal. The second contacts are partly received in the receiving space (110). The first contacts are partly received in the cavity (120). The engaging section of the extra signal contact (3*e*) is located on an inner surface of the lower wall.

18 Claims, 15 Drawing Sheets

ELECTRICAL CONNECTOR ASSEMBLY HAVING EXTRA SIGNAL CONTACT

BACKGROUND OF THE INVENTION

1. Field of the Invention

The present invention relates generally to an electrical connector assembly, and more particularly to an electrical connector assembly including an extra signal contact for transmitting an extra signal.

2. Description of Related Arts

U.S. Pat. No. 7,559,805, issued on Jul. 14, 2009, discloses that an electrical connector assembly comprises: a first opening accommodating a plurality of first plug contacts; a second opening having a plurality of second plug contacts exposed thereto; the first and the second openings separated by a separate plate and the first and the second plug contacts disposed on opposite first and second sides of the separate plate, respectively; and a pair of plug power contacts having contact portions located on opposite lateral sides of the second opening, the contact portions being exposed to the second opening.

An electrical connector assembly adding an extra contact to the second opening is needed.

SUMMARY OF THE INVENTION

Accordingly, an object of the present invention is to provide an electrical connector assembly with an extra function.

To achieve the above object, an electrical connector assembly includes an electrical connector assembly includes an insulative housing comprising a top wall, a lower wall, two side walls, a receiving space surrounded by the top wall, the lower wall and the two side walls, a cavity above the receiving space, a shielding shell enclosing the insulative housing, a plurality of contacts received in the insulative housing and a cable connected with a rear of the contacts. The contacts comprise a plurality of first contacts for transmitting USB 3.0 signal and a plurality of second contacts. The second contacts comprise a power contact, a positive signal contact, a negative signal contact, a grounding contact, these power, positive signal, negative signal, and grounding contacts transmitting USB 2.0 signal, and an extra signal contact. Each contact comprises an engaging section and a soldering section. The extra signal contact transmits an extra signal. The engaging sections of the second contacts are received in the receiving space. The engaging sections of the first contacts are received in the cavity. The engaging section of the extra signal contact is located on an inner surface of the lower wall.

To achieve the above object, an electrical connector assembly includes an insulative housing, a plurality of contacts received in the insulative housing, a cable connected with the contacts, an inner insulator comprising a wrapping portion wrapping a rear end of the insulative housing and a front end of the cable and a supporting portion extending rearwardly from the wrapping portion, a shielding shell mounted onto the inner insulator and defining a gap and a copper foil mounted to the shielding shell. The supporting portion is exposed outwardly via the gap for supporting the copper foil.

Other objects, advantages and novel features of the invention will become more apparent from the following detailed description when taken in conjunction with the accompanying drawings.

DETAILED DESCRIPTION OF THE PREFERRED EMBODIMENT

Figure 1:
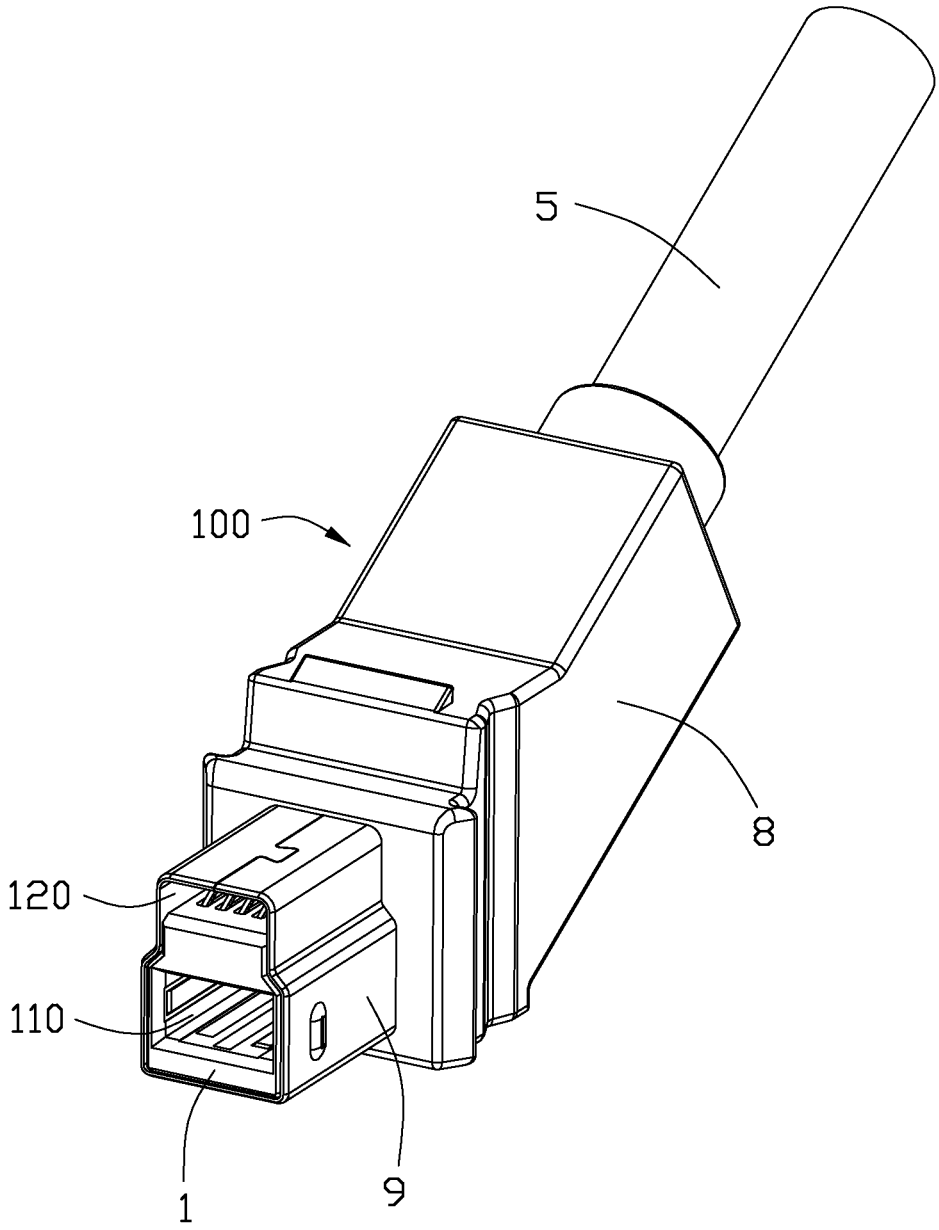
FIG. 1 is a perspective, assembled view of an electrical connector assembly of the present invention.
Figure 2:
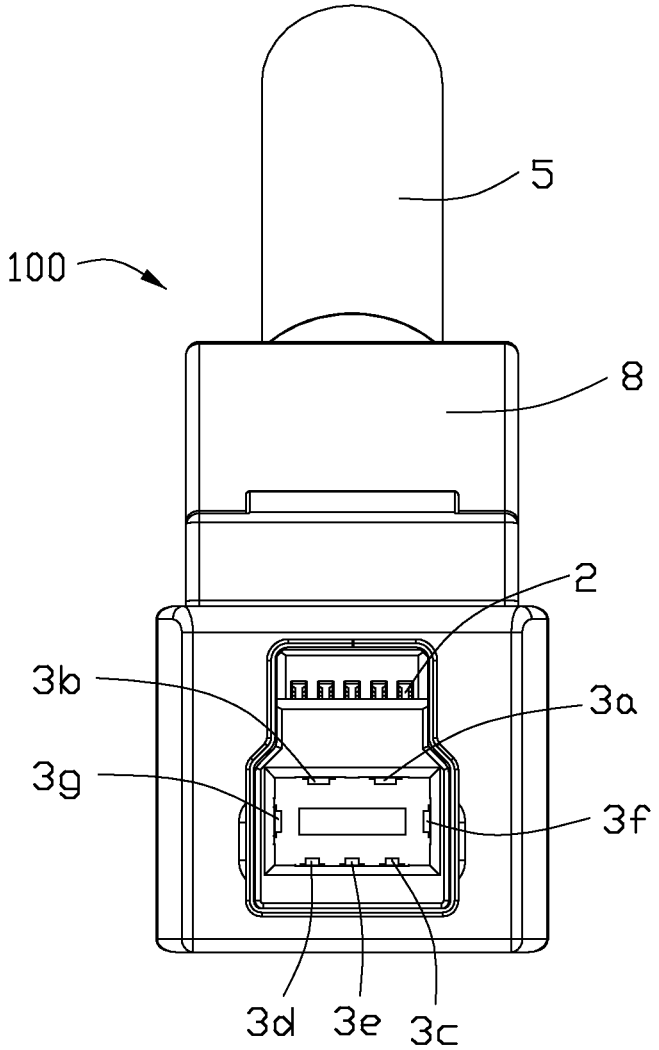
FIG. 2 is a front view of the electrical connector assembly shown in FIG. 1.
Figure 3:
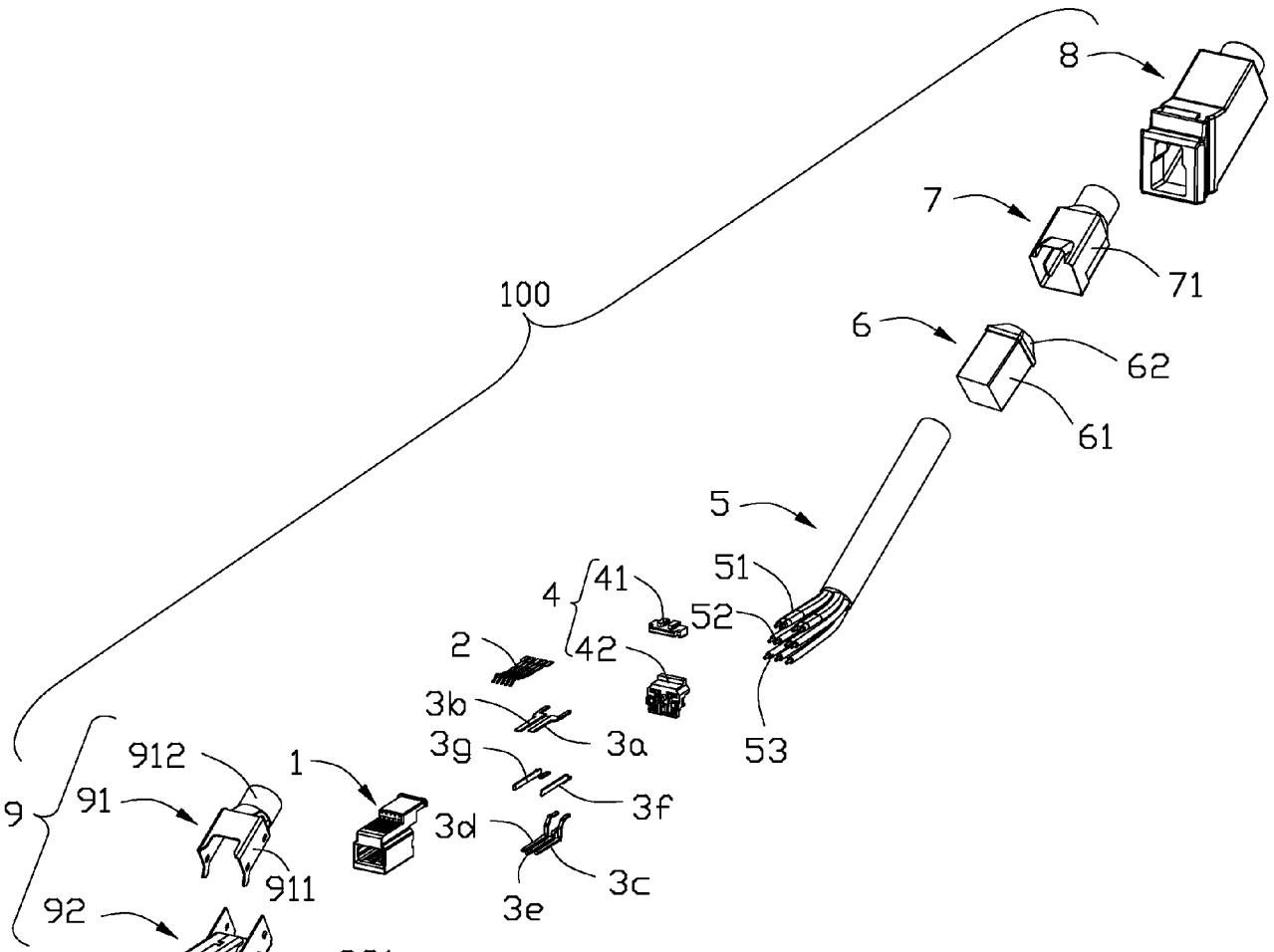
FIG. 3 is a perspective, exploded view of the electrical connector assembly shown in the FIG. 1.
Figure 4:
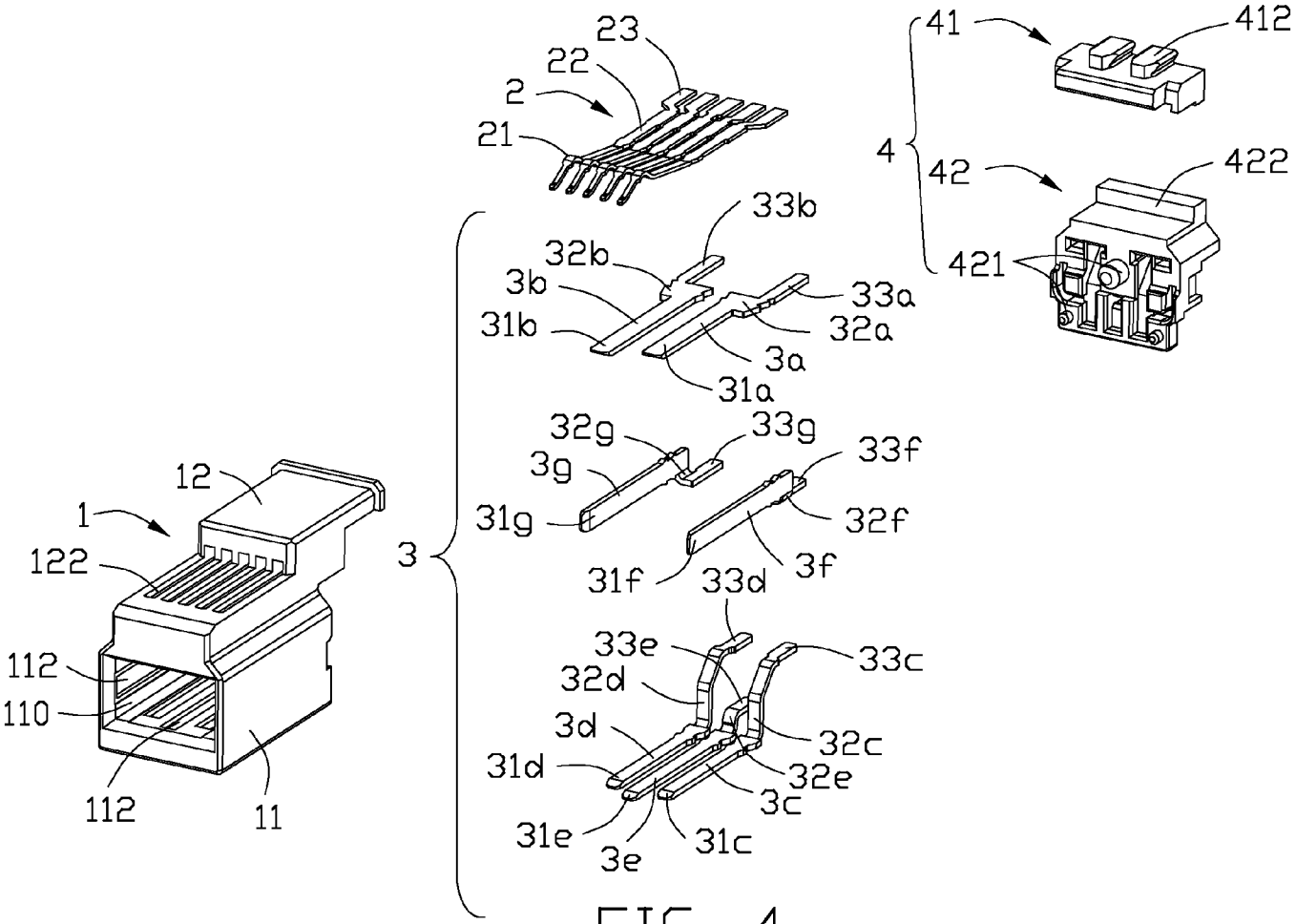
FIG. 4 is an enlarged view of a housing, a plurality of contacts and a spacer of the electrical connector assembly shown in FIG. 3.
Figure 5:
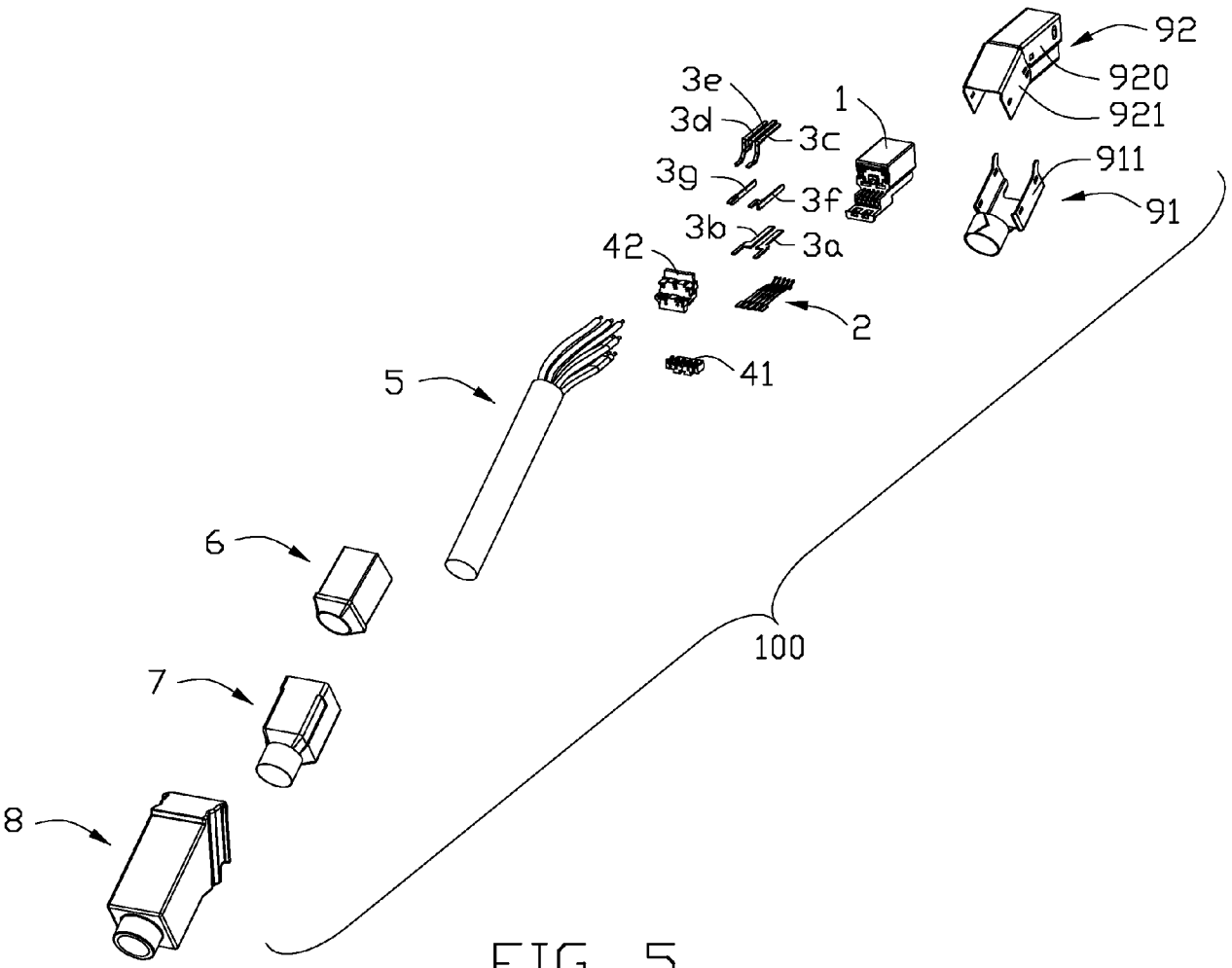
FIG. 5 is another perspective, exploded view of the electrical connector assembly, taken from a different view with respect to FIG. 3.
Figure 6:
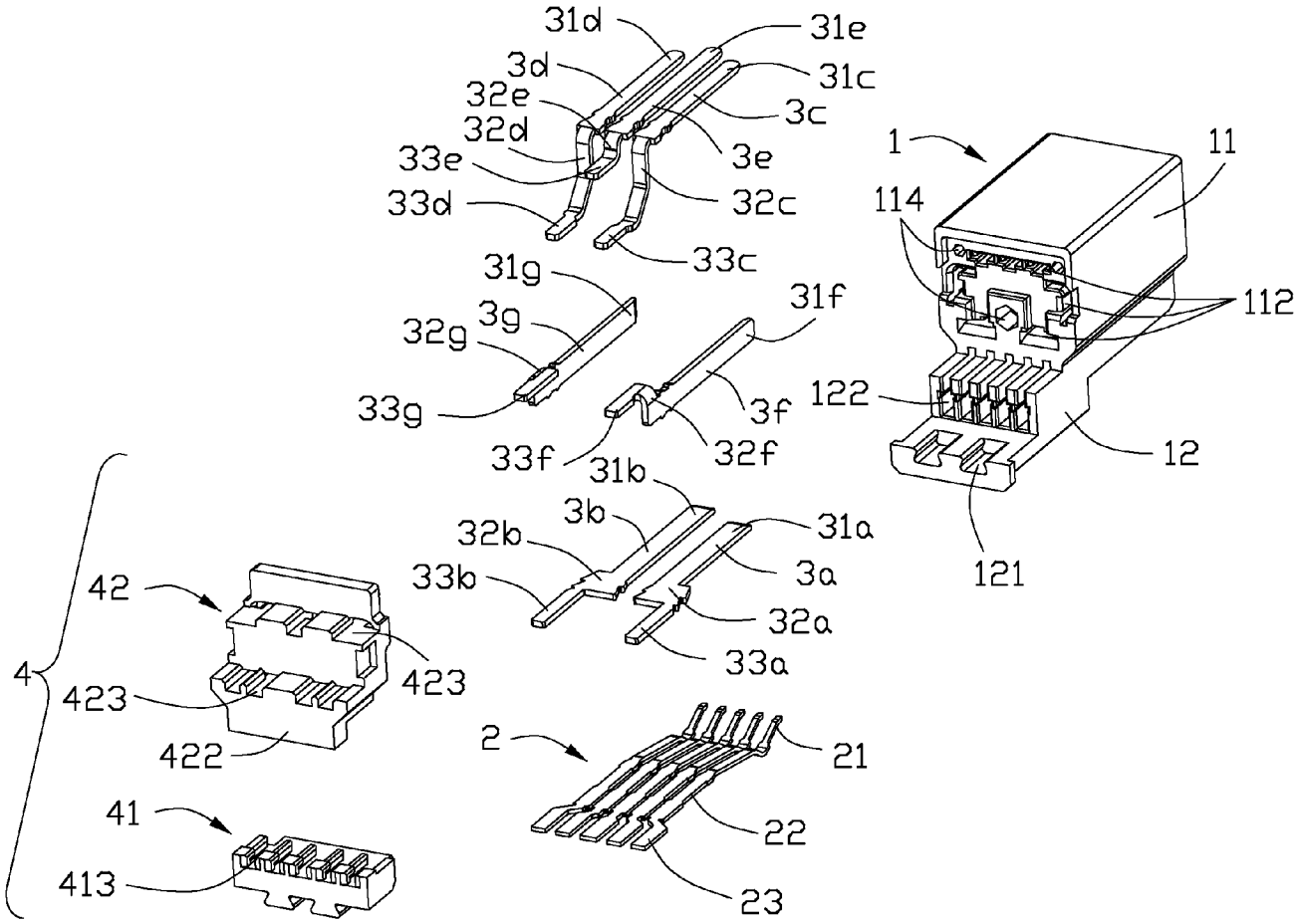
FIG. 6 is an enlarged view of a housing, the contacts and the spacer of the electrical connector assembly shown in FIG. 5.
Figure 7:
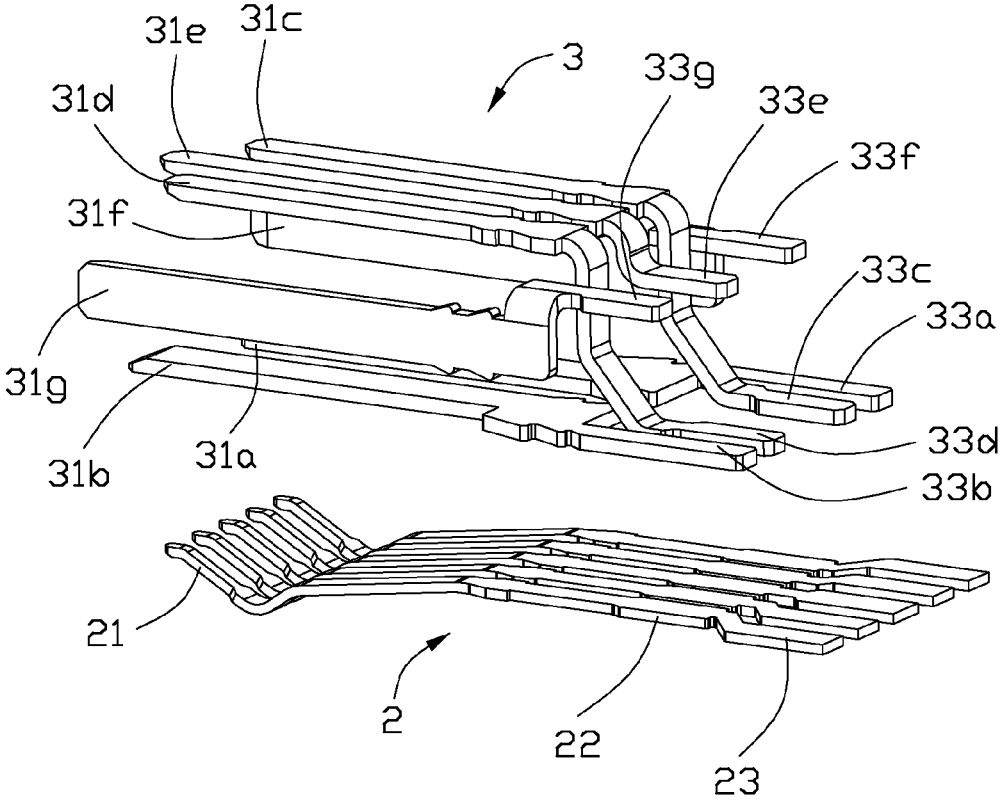
FIG. 7 is a perspective, assembled view of the contacts of the electrical connector assembly shown in FIG. 1.
Figure 8:
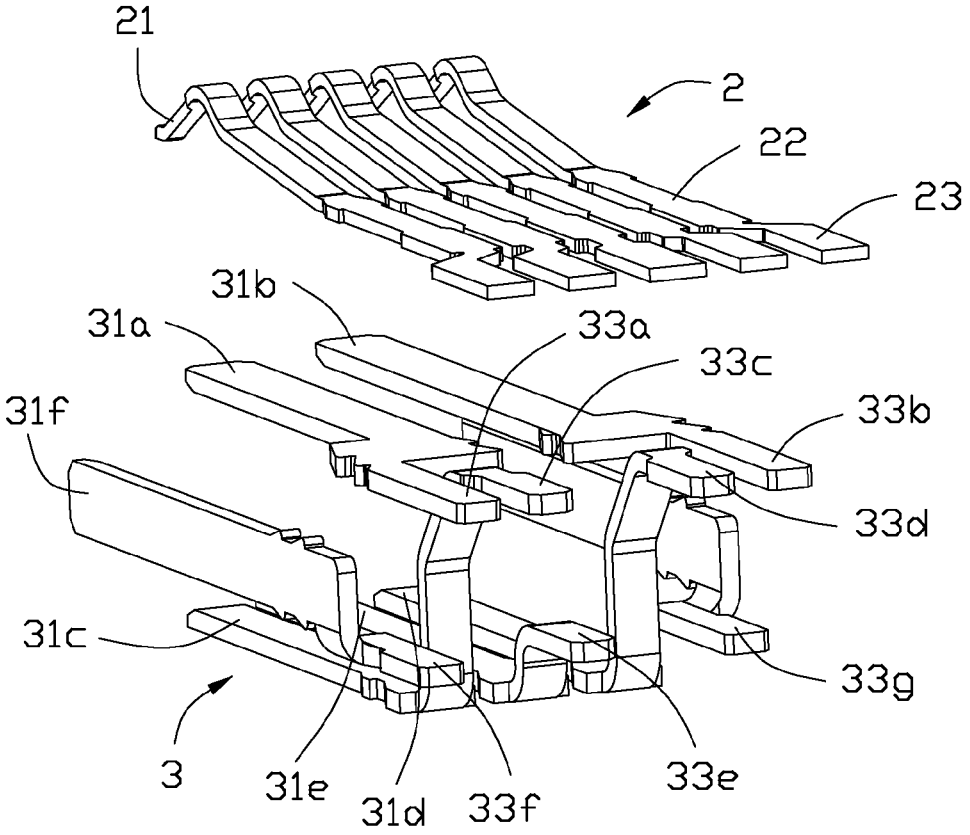
FIG. 8 is an another perspective, assembled view of the contacts of the electrical connector assembly, taken from a different view with respect to FIG. 7.
Figure 9:
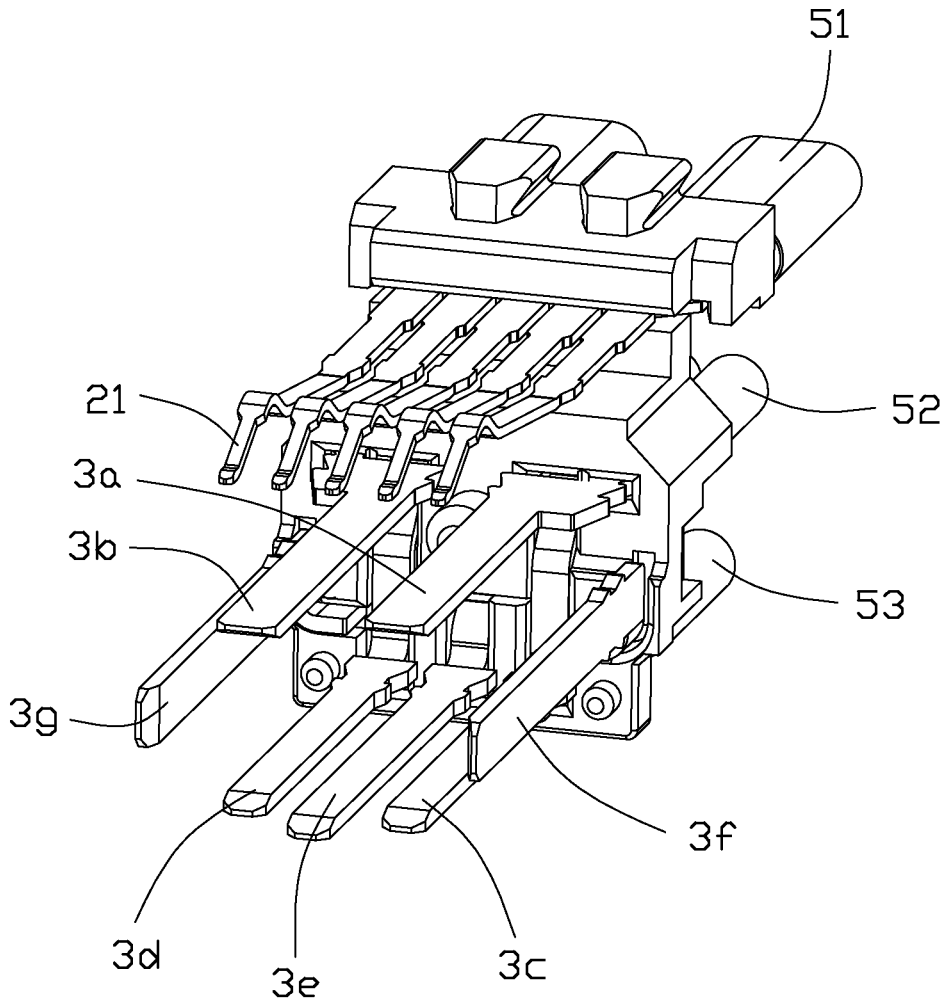
FIG. 9 is a perspective, assembled view of the contacts, the spacer and a cable of the electrical connector assembly shown in FIG. 1.
Figure 10:
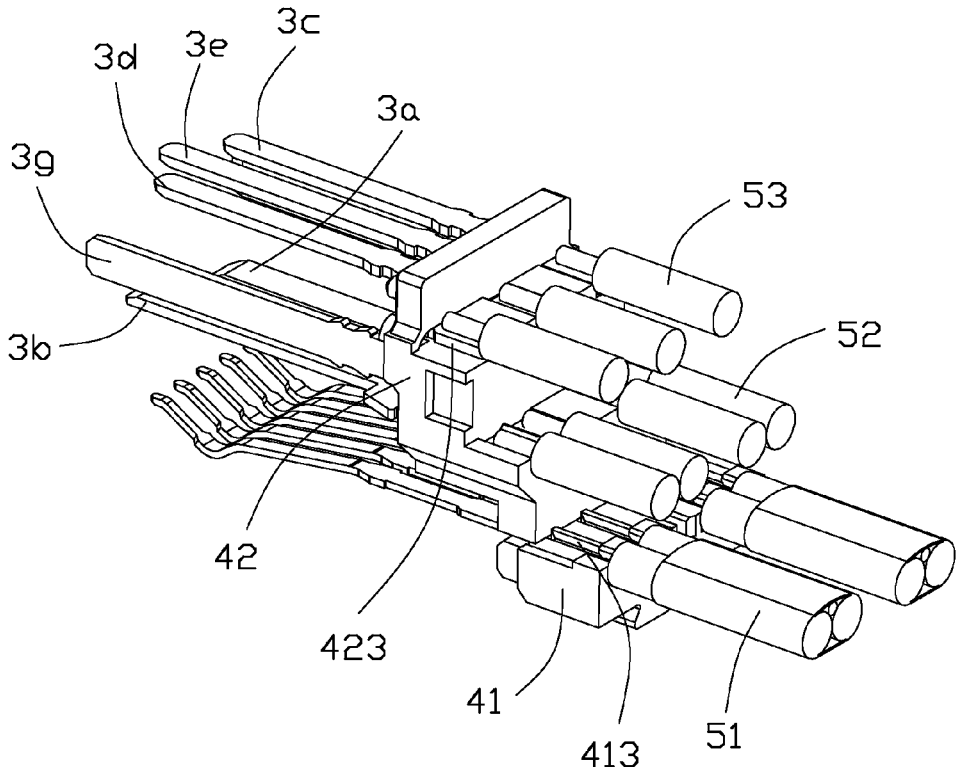
FIG. 10 is another perspective, assembled view of the contacts, the spacer and the cable of the electrical connector assembly, taken from a different view with respect to FIG. 9.
Figure 11:
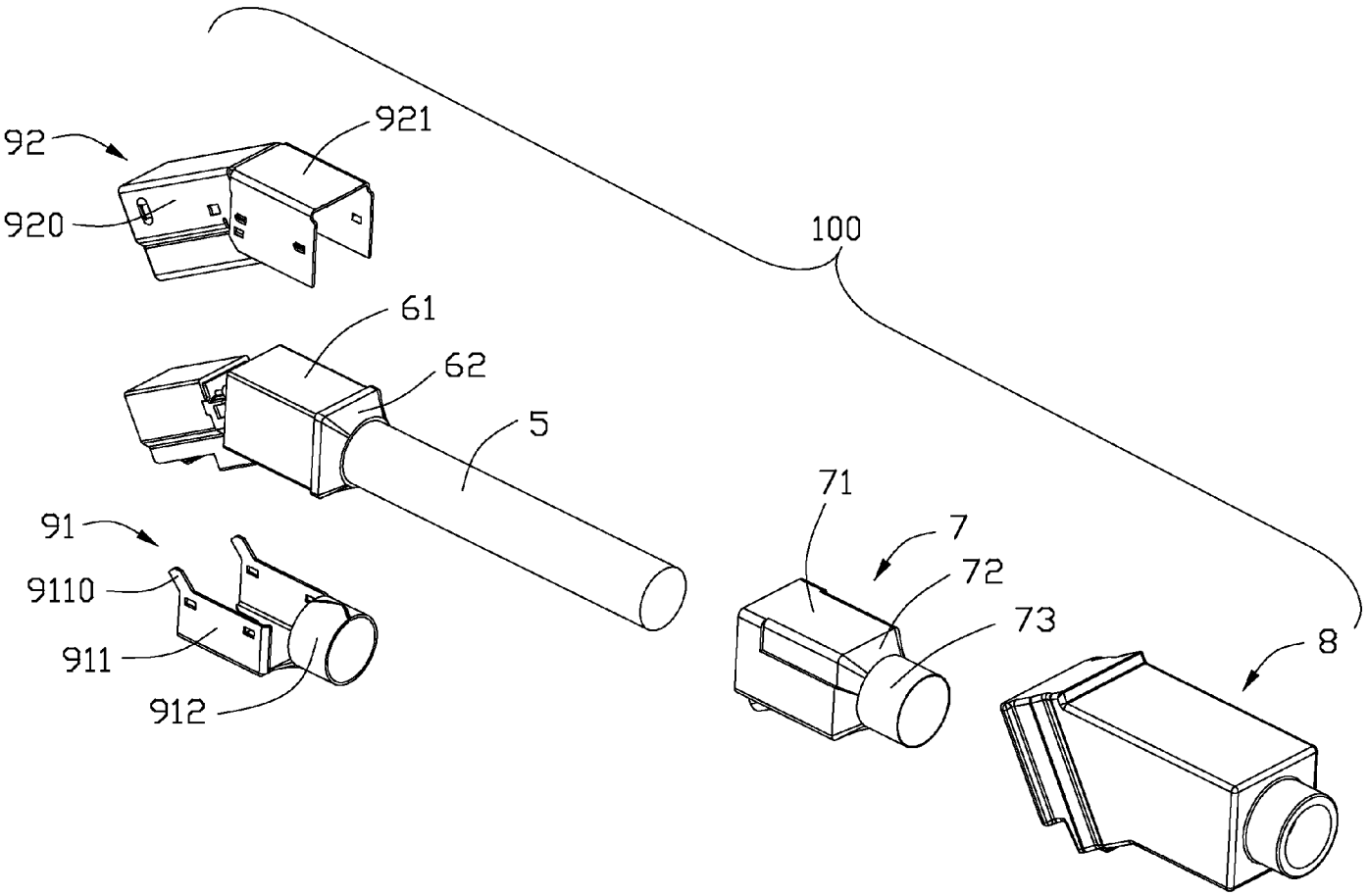
FIG. 11 is a perspective, partially assembled view of the electrical connector assembly shown in FIG. 1.
Figure 12:
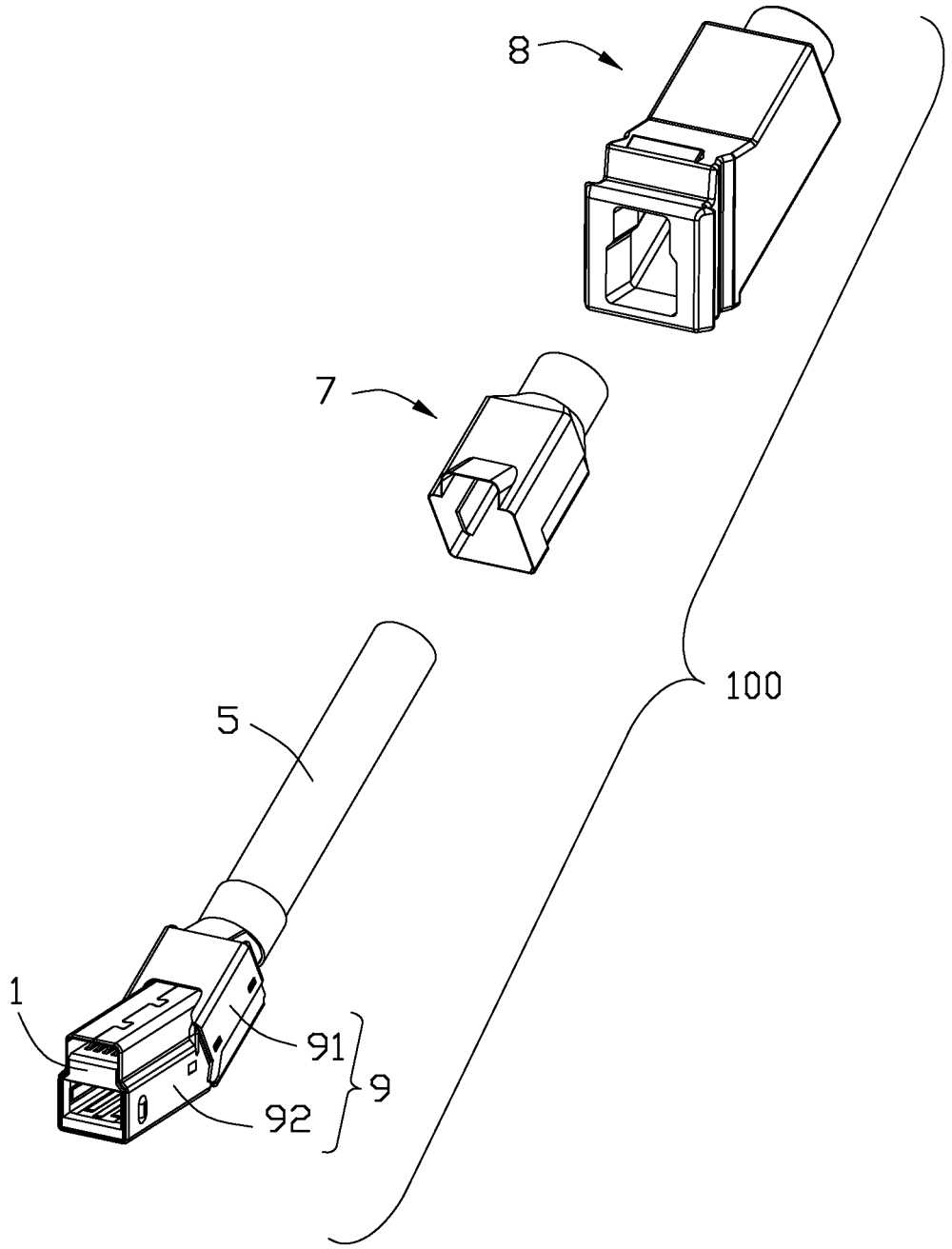
FIG. 12 is a perspective, further partially assembled view of the electrical connector assembly shown in FIG. 11.
Figure 13:
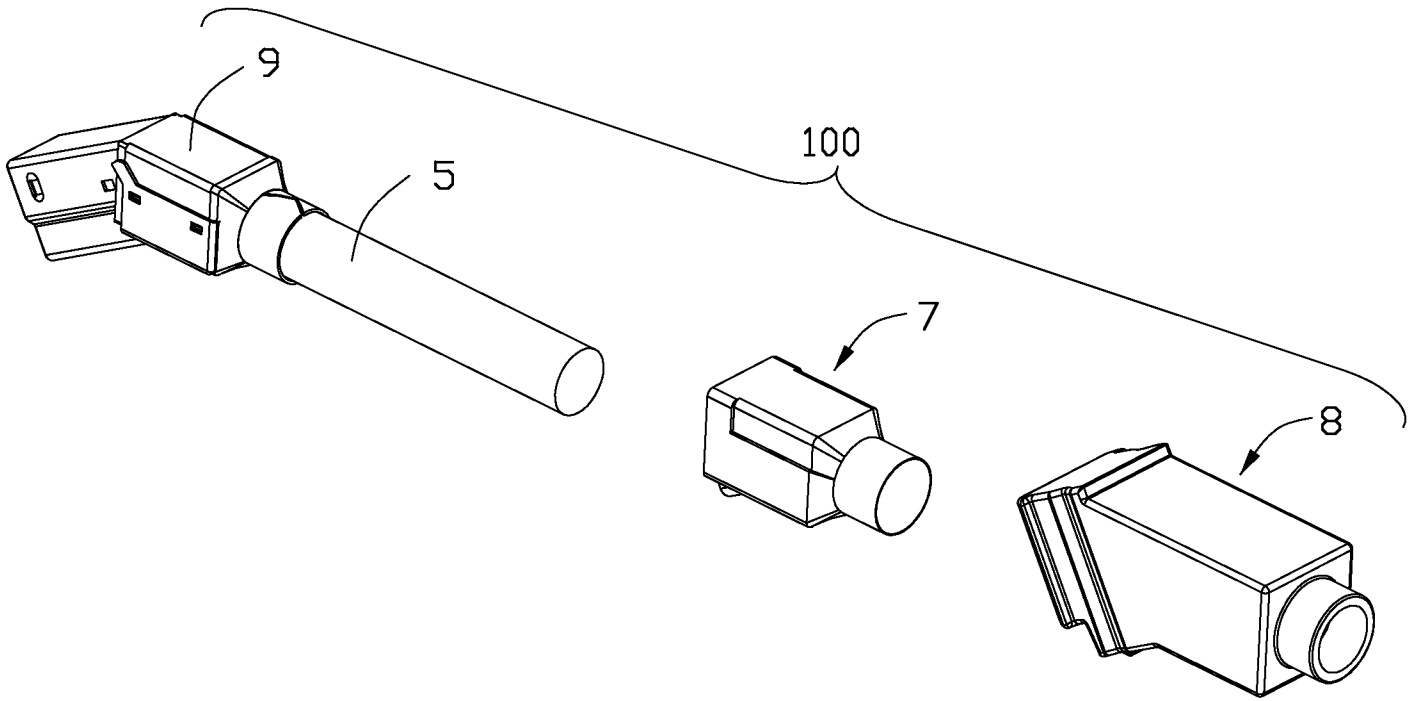
FIG. 13 is an another perspective, partially assembled view of the electrical connector assembly, taken from a different view with respect to FIG. 12.
Figure 14:
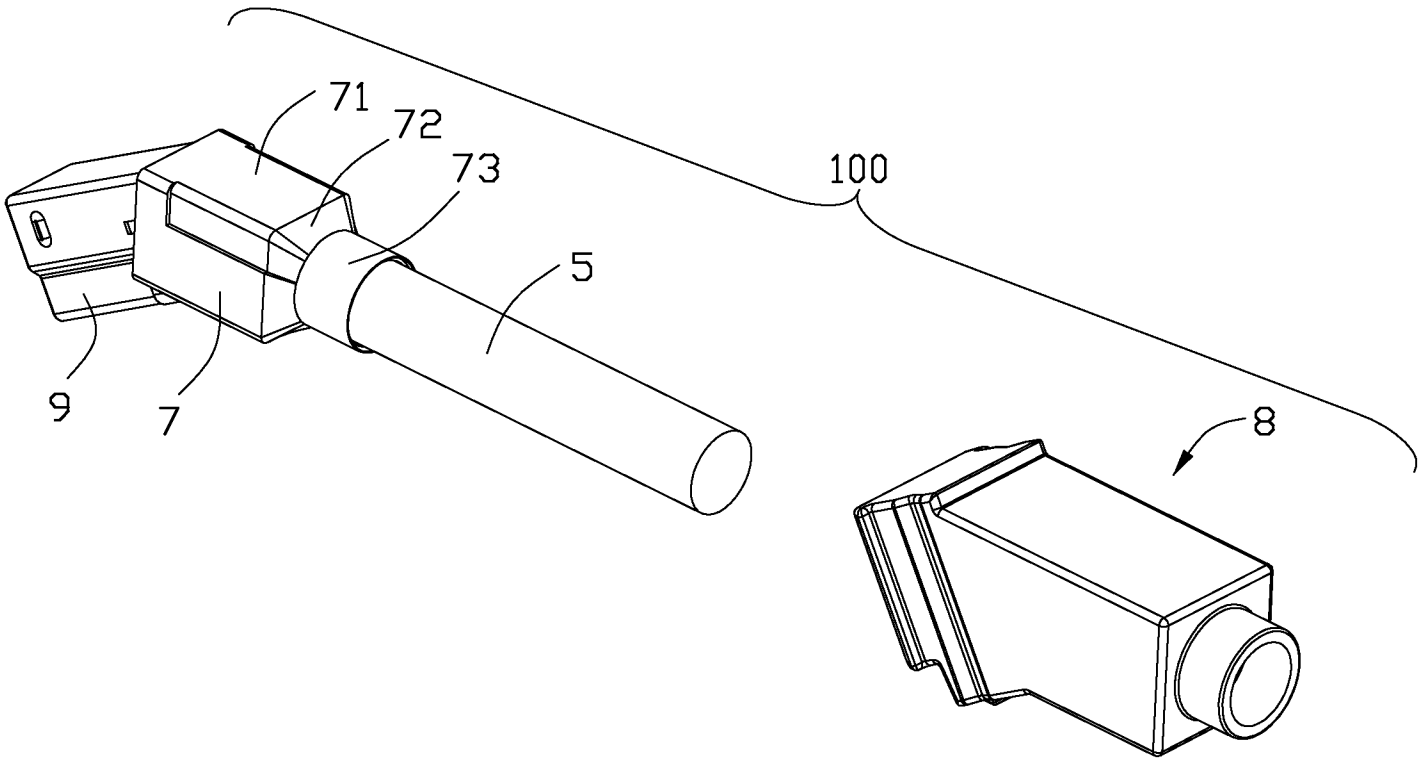
FIG. 14 is a perspective, further partially assembled view of the electrical connector assembly shown in FIG. 13.

Reference will now be made in detail to the preferred embodiment of the present invention. Referring to FIGS. 1 to 12, an electrical connector assembly 100 of the present invention comprises an insulative housing 1, a plurality of contacts 2, 3 received in the insulative housing 1, a spacer 4 assembled to an end of the insulative housing 1, a cable 5 electrically connecting to the contacts 2, 3, an inner insulator 6 mounted to the rear end of the insulative housing 1 and the front end of the cable 6, a shielding shell 9 enclosing the insulative housing 1, a copper foil 7 mounted to a rear end of the shielding shell 9, a cover 8 mounted to the shielding shell 9 and the copper foil 7. The contacts 2, 3 comprise a plurality of first contacts 2 and a plurality of second contacts 3. The electrical connector assembly 100 defines a receiving space 110 and a cavity 120 located above the receiving space 110. The contacts 2, 3 comprises an engaging section and a soldering tail, a plurality of engaging sections of the second contacts 3 are accommodated in the receiving space 110, a plurality of engaging sections of the first contacts 2 are accommodated in the cavity 120.

Referring to FIGS. 3 to 6, the insulative housing 1 includes a base section 11 and a rear section 12. The base section 11 defines a top wall, a lower wall, two side walls and the receiving space 110 extending from a mating direction and surrounded by said four walls. Inner faces of the top wall, the lower wall and the two side walls define a plurality of second receiving passageways 112 for receiving the second contacts 3 respectively. The top wall defines two second receiving passageways 112, the lower wall defines three second receiving passageways 112, the two side walls define a receiving passageway 112 respectively. The receiving passageways 112 extend from the front and rear direction and reach to the rear surface of the base section 11. The rear section 12 extends upwardly and rearwardly from the top surface of the base section 11 and the base section 11 and the rear section 12 form a trapeziform shape. The rear section 12 defines a plurality of first receiving passageways 122 through a front surface and a back surface for receiving the first contacts 2, and a front end of the first receiving passageway 122 extend to the top surface of the base section 11.

Referring to FIGS. 4 to 8, the first contacts 2 are used for high-speed transmission and comprise two pairs of differential signal contacts and a grounding contact. One pair of the two pairs of differential signal contacts are used for exporting high-speed transmission, and the other pair of the differential signal contacts are used for receiving high-speed transmission. The grounding contact is located in the middle of the two pairs of differential signal contacts for reducing a signal interference. Each first contact 2 comprises an elastic engaging section 21, a soldering tail 23 and a connecting section 22 connecting the engaging section 21 and the soldering tail 23. The soldering tails 23 are arranged in a row along the horizontal direction, the distance between the soldering tails 23 of the two outmost pairs of the first contacts 2 is bigger than the distance between the engaging sections 21 thereof. The first contacts 2 are received in the first receiving passageways 122 of the insulative housing 1.

Referring to FIGS. 2 to 8, each second contact 3 comprises an engaging section, a soldering tail and a connecting section connecting the engaging section and the soldering tail. The second contact 3 comprises a negative signal contact 3*a*, a power contact 3*b*, a positive signal contact 3*c*, a grounding contact 3*d*, an extra grounding contact 3*f*, an extra power contact 3*g* and an extra signal contact 3*e*.

The second contacts 3 having upper contacting portions 31 are labeled as 3*b*, 3*a* from left to right, the second contacts 3 having lower contacting portions 31 are labeled as 3*d*, 3*e*, 3*c* along a left to right direction, the second contacts 3 having middle contacting portions 31 are labeled as 3*g*, 3*f*. The negative signal contact 3*a* and the power contact 3 comprise tabular engaging sections 31*a*, 31*b*, soldering tails 33*a*, 33*b* and connecting sections 32*a*, 32*b*, respectively. The soldering tails 33*a*, 33*b* and the engaging sections 31*a*, 31*b* are coplanar and the distance between the soldering tails 33*a*, 33*b* is bigger than the distance between the engaging sections 31*a*, 31*b*. The positive signal contact 3*c* and the grounding contact 3*d* comprise tabular engaging sections 31*c*, 31*d*, connecting sections 32*c*, 32*d* extending upwardly and rearwardly from the engaging sections 31*c*, 31*d*, and soldering tails 33*c*, 33*d* extending rearwardly from the connecting sections 32*c*, 32*d*, respectively. The soldering tails 33*c*, 33*d* and the soldering tails 33*a*, 33*b* are coplanar. The extra signal contact 3*e* comprises a tabular engaging section 31*e*, a connecting section 32*e* extending upwardly and rearwardly from the engaging section 31*e* and a soldering section 33*e* extending rearwardly from the connecting section 32*e*. The soldering section 33*e* and the soldering sections 33*c*, 33*d* are not coplanar. The extra grounding contact 3*f* and the extra power contact 3*g* comprise vertical engaging section 31*g*, 31*f*, soldering tails 33*g*, 33*f* bent toward each other and extending rearwardly horizontally and connecting sections 32*g*, 32*f* connecting the engaging section 31*g*, 31*f* and the soldering tails 33*g*, 33*f*. The soldering tails 33*g*, 33*f* and the soldering tail 33*e* are coplanar.

The engaging section 31*b* of the power contact 3*b* and the engaging section 31*a* of the negative contact 3*a* are located on the inner surface of the top wall. The engaging section 31*c* of the positive contact 31 and the engaging section 31*d* of the grounding contact 3*d* are located on the inner surface of the lower wall and located at opposite sides of the engaging section 31*e* of the extra signal contact 3*e*. The soldering sections 33*a* of the negative signal contact 3*a*, the soldering sections 33*b* of the positive signal contact 33, the soldering sections 33*d* of the grounding contact 3*d* and the soldering sections 33*b* of the power contact 3*b* are arranged along an upper row from right to left. The soldering sections 33*f* of the extra grounding contact 3*f*, the soldering sections 33*e* of the extra signal contact 3*e* and the soldering sections 33*g* of the extra power contact 3*g* are arranged along a lower row from right to left.

Referring to FIGS. 7 to 10, the soldering tails 33*a*, 33*b* and the engaging sections 31*a*, 31*b* are coplanar and the distance between the soldering tails 33*a*, 33*b* is bigger than the distance between the engaging sections 31*a*, 31*b*. The positive signal contact 3*c* and the grounding contact 3*d* comprise tabular engaging sections 31*c*, 31*d*, connecting sections 32*c*, 32*d* extending upwardly and rearwardly from the engaging sections 31*c*, 31*d*, and soldering tails 33*c*, 33*d* extending rearwardly from the connecting sections 32*c*, 32*d*, respectively. The soldering tails 33*c*, 33*d* and the soldering tails 33*a*, 33*b* are coplanar. The extra signal contact 3*e* comprises a tabular engaging section 31*e*, a connecting section 32*e* extending upwardly and rearwardly from the engaging section 31*e* and a soldering section 33*e* extending rearwardly from the connecting section 32*e*. The front face of engaging section 31*e* of the extra signal contact 3*e* is closer to the front face of the insulative housing 1 than the front face of the engaging sections 31*c*, 31*d* of the positive contact 3*c* and the grounding contact 3*d*.

The soldering section 33*e* and the soldering sections 33*c*, 33*d* are not coplanar. The extra grounding contact 3*f* and the extra power contact 3*g* comprise vertical engaging section 31*g*, 31*f*, soldering tails 33*g*, 33*f* bent toward each other and extending rearwardly on the horizontal and connecting sections 32*g*, 32*f* connecting the engaging section 31*g*, 31*f* and the soldering tails 33*g*, 33*f*. The soldering tails 33*g*, 33*f* and the soldering tail 33*e* are coplanar.

The spacer 4 is assembled to the rear of the insulative housing 1, and comprises an upper spacer 41 and a lower spacer 42 assembled to the upper spacer 41. The lower spacer 42 is assembled to the rear of the base section 11 of the insulative housing 1. The lower spacer 42 comprises a plurality of posts 421 extending forwardly from a front face of the lower spacer 42, two step faces formed on the rear end and a limit block 422 extending upwardly from the front end of the upper step face and mating with the upper spacer 41. The base section 11 of the insulative housing 1 defines a plurality of mounting holes 221 mating with the corresponding posts 421. The step faces define a plurality of soldering grooves 423 of the soldering tails 33 of the second contacts 3. The upper spacer 41 is assembled to the rear of the rear section 12 and the upper of the lower spacer 42. The upper spacer 41 defines a plurality of fixed blocks 412 extending upwardly from the top surface thereof and a plurality of soldering grooves 413 formed on the lower surface thereof for receiving the soldering tails 23 of the first contacts 2. The rear section 12 of the insulative housing 1 defines a plurality of dovetail grooves 121 formed on the lower surface thereof for receiving the fixed blocks 412. The dovetail grooves 121 and the fixed blocks 412 are trapezoid.

Figure 15:
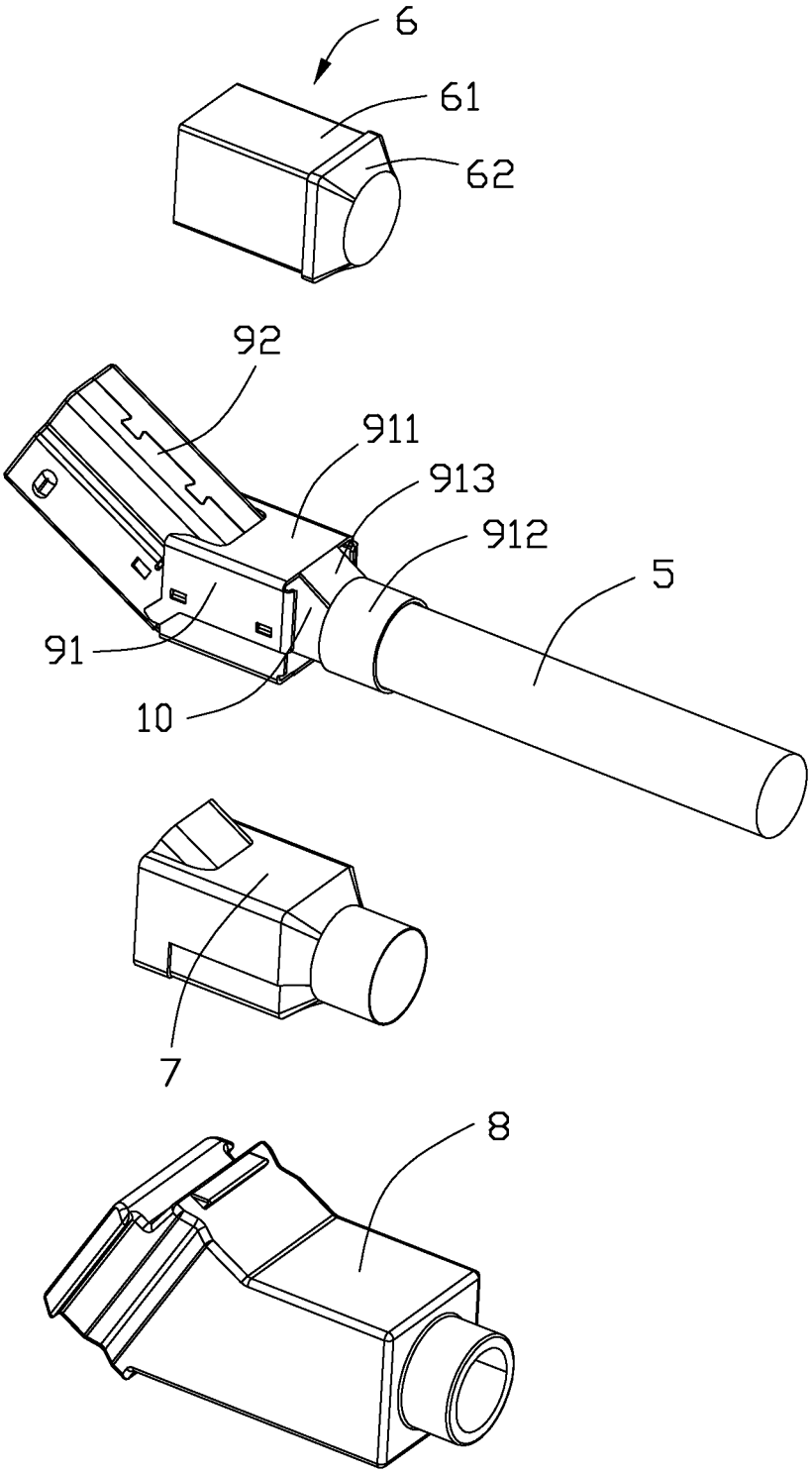
FIG. 15 is an exploded view of the cable, an inner insulator, a copper foil, and a cover and a shielding shell.

The shielding shell 9 is made of metallic material, and comprises a first shielding shell 91 and a second shielding shell 92 assembled to the first shielding shell 91. The second shielding shell 92 comprises a tubular portion 920 and a drawer portion 921 extending rearwardly from the tubular portion 920. The cross section of tubular portion 920 is convex. The first shielding shell 91 is mounted to the drawer portion 921 of the second shielding shell 92. The first shielding shell 91 comprises a mating portion 911, a pair of springs 9110 formed at the front end of the side walls thereof, a holding portion 912 extending rearwardly from the rear thereof and a connecting arm 913 connecting the holding portion 912 and the mating portion 911. There is a gap 10, referring to FIG. 15, formed in the rear of the shielding shell 9 surrounded by the drawer portion 921, the mating portion 911, the connecting arm 913 and the holding portion 912.

The cable 5 comprises a first row of wires 51, a second row of wires 52 and a third row of wires 53 having different diameters. The diameters of the three rows of wires 51, 52, 53 decreases by degrees from upper to lower. In actual, the real diameters of each row of the three rows of wires 51, 52, 53 are not necessarily identical and the wires have similar diameters are placed in a row. The first row of wires 51 are soldered with the soldering sections 23 for transmitting a USB 3.0 signal. The second row of wires 52 are soldered with the soldering sections 33*a*, 33*c*, 33*d*, 33*b* of the upper row of the second contact 3 from left to right, respectively. The third row of wires 53 are soldered with the soldering sections 33*f*, 33*e*, 33*g* of the lower row of the second contact 3 from left to right, respectively. The wires have similar diameters are placed in a row, so that the cable 5 and the contacts 2, 3 can be soldered automatically.

The inner insulator 6 comprises a wrapping portion 61 and a conical supporting portion 62 extending rearwardly from the wrapping portion 61. The copper foil 7 comprises a main portion 71 mounted to the shielding shell 9, a tilting portion 72 extending rearwardly from the main portion and a ring portion 73 extending rearwardly from the tilting portion 72. The cover 8 is molded to the shielding shell 9, the copper foil 7 and a front end of the cable 5.

Referring to FIGS. 1 to 14, in assembly, the first contacts 2 are received in the first receiving passageway 122, the second contacts 3 are divided into three rows and received in the second receiving passageway 112, respectively. The spacer 4 is mounted to the rear of the insulative housing 1. The soldering sections 23, 33 of the first contacts 2 and the second contacts 3 arranged into two rows pass through the spacer 4 and are received in the corresponding soldering grooves 413, 423, and then the soldering sections 23, 33 are soldered to the corresponding first contacts 2 and the corresponding second contacts 3. The second shielding shell 92 is mounted to the insulative housing 1, and the cavity 120 are located above the receiving space 110 and formed surrounded by the top wall of the shielding shell 92 and the top surface of the base section 11. The first contacts 2 are received in the cavity 120, the second contacts 3 are received in the receiving space 110. The inner insulator 6 is molded out of a connecting portion of the contacts 2, 3 and the cable 5. The supporting portion 62 is exposed outwardly via the gap 10 for supporting the copper foil 7. The supporting portion 62 has a configuration mating that of the tilting portion 72. The first shielding shell 91 is assembled to the rear of the second shielding shell 92, and then the first shielding shell 91 and the second shielding shell 92 encloses the insulator housing 1, the inner insulator 6 and the front end of cable 5. The copper foil 7 is mounted to the rear of the shielding shell 9, and the cover 8 is molded out of the shielding shell 9 and the copper foil 7. In the present invention, the copper foil 7 can improve the function of EMI. The supporting portion 62 supports the copper foil 7 for preventing the copper foil 7 to be crushed while the cover 8 is molded, and then achieving the function of EMI better.

In the present invention, the first contacts 2 transmit the USB 3.0 signal, the power contact 3*b*, the positive signal contact 3*c*, the negative signal contact 3*a* and the grounding contact 3*d* of the second contacts 3 transmit the USB 2.0 signal. The extra signal contact 3*e* of the second contacts 3 can transmit an extra signal from the out device to the electrical connector assembly 100 for achieving an extra requirement. The front surface of the engaging section 31*e* of the extra signal contact 3*e* is closer to the front surface of the insulative housing 1 than the engaging sections 31*c*, 31*d* of the positive signal contact 3*c* and the grounding contact 3*d*, so that the extra signal contact 3*e* can transmit the extra signal firstly. The soldering sections of the second contacts 3 are divided into two rows. The cable are divided into three rows according the different diameters and then connected with the first contacts 2 and the second contacts 3, respectively. The cable 5 can be efficiently soldered to the first contacts 2 and the second contacts 3 and the function of EMI can be improved at the same time.

What is claimed is:

1. An electrical connector assembly, comprising:

an insulative housing comprising a top wall, a lower wall, two side walls, a receiving space surrounded by the top wall, the lower wall and the two side walls, and a cavity above the receiving space;

a shielding shell enclosing the insulative housing;

a plurality of contacts received in the insulative housing, the contacts comprising a plurality of first contacts and a plurality of second contacts, the second contacts comprising a power contact, a positive signal contact, a negative signal contact, a grounding contact, and an extra signal contact, each contact comprising an engaging section and a soldering section;

a cable connected with a rear of the contacts;

an inner insulator mounted to the rear end of the insulative housing and the front end of the cable, the inner insulator comprising a wrapping portion and a conical supporting portion extending rearwardly from the wrapping portion; and a copper foil mounted to the rear of the shielding shell, the rear end of the shielding shell enclosing the inner insulator, the copper foil comprising a tilting portion mounted to the supporting portion of the inner insulator;

wherein the engaging sections of the second contacts are received in the receiving space, the engaging sections of the first contacts are received in the cavity, the engaging section of the extra signal contact is located on an inner surface of the lower wall.

2. The electrical connector assembly as claimed in claim 1, wherein the engaging sections of the power contact and the negative signal contact are located on the inner surface of the top wall, and the engaging sections of the positive signal contact and the grounding contact are located on the inner surface of the lower wall and located at opposite sides of the extra signal contact.

3. The electrical connector assembly as claimed in claim 2, wherein a front surface of the engaging section of the extra signal contact is closer to the front surface of the insulative housing than the engaging sections of the positive signal contact and the grounding signal contact.

4. The electrical connector assembly as claimed in claim 2, wherein the second contacts comprise an extra power contact and an extra grounding contact, the engaging sections of the extra power contact and the extra grounding contact located on inner surfaces of the side walls of the insulative housing.

5. The electrical connector assembly as claimed in claim 2, wherein the soldering sections of the negative signal contact, the positive signal contact, the grounding contact, and the power contact are arranged in an upper row from right to left, and the soldering sections of the extra grounding contact, the extra signal contact, and the extra power contact are arranged in a lower row from right to left.

6. The electrical connector assembly as claimed in claim 5, wherein the cable comprises three rows of wires, the first row of wires soldered to the soldering sections of the first contacts, the second row of wires soldered to the upper row of the soldering sections of the second contacts, the third row of wires soldered to the lower row of the soldering sections of the second contacts.

7. The electrical connector assembly as claimed in claim 1, wherein the shielding shell comprises a first shielding shell and a second shielding shell assembled to the first shielding shell, the second shielding shell comprising a tubular portion and a drawer portion extending rearwardly from the tubular portion.

8. The electrical connector assembly as claimed in claim 1, further comprising a spacer mounted to a rear end of the insulative housing and a cover mounted to the shielding shell, the insulative housing comprising a base section and a rear section extending rearwardly from the base section, the spacer comprising an upper spacer and a lower spacer.

9. An electrical connector assembly comprising:

an insulative housing;

a plurality of contacts received in the insulative housing;

a cable connected with the contacts;

an inner insulator comprising a wrapping portion wrapping a rear end of the insulative housing and a front end of the cable and a supporting portion extending rearwardly from the wrapping portion;

a shielding shell mounted onto the inner insulator and defining a gap with regard to the cable; and a copper foil mounted to the shielding shell and comprising a main portion wrapping the shielding shell and a tilting portion extending rearwardly from the main portion; wherein the supporting portion fills the gap for supporting the copper foil and has a configuration matching that of the tilting portion.

10. The electrical connector assembly as claimed in claim 9, wherein the wrapping portion is overmolded with the rear end of the insulative housing and the front end of the cable.

11. The electrical connector assembly as claimed in claim 9, wherein the copper foil further comprises a ring portion extending rearwardly from the tilting portion.

12. The electrical connector assembly as claimed in claim 9, wherein the shielding shell comprises a first shielding shell and a second shielding shell assembled to the first shielding shell, the second shielding shell comprising a tubular portion and a drawer portion extending rearwardly from the tubular portion, the first shielding shell comprising a mating portion, a holding portion extending rearwardly from the rear thereof, and a connecting arm connecting the holding portion and the mating portion.

13. The electrical connector assembly as claimed in claim 12, wherein the gap is surrounded by the drawer portion, the mating portion, the connecting arm, and the holding portion.

14. The electrical assembly as claimed in claim 9, wherein said supporting portion forms a truncated pyramidal configuration.

15. An electrical connector assembly comprising:

an insulative housing forming a receiving space surrounded by opposite upper and lower interior surface in a vertical direction, and opposite side interior surfaces in a transverse direction perpendicular to said vertical direction;

a plurality of first contacts disposed in the housing with corresponding first contacting sections located on the upper interior surface;

a plurality of second contacts disposed in the housing with second contacting sections located on the side interior surfaces;

a plurality of third contacts disposed in the housing with third contacting sections located on the lower interior surface;

some of the first contacts having corresponding tail sections extending toward the third contacts to be grouped with those of the third contacts in the transverse direction, and remainder of the third contacts having the corresponding tail sections grouped with those of the second contacts in said transverse direction.

16. The electrical connector assembly as claimed in claim 15, wherein all the third contacts lie in one same horizontal plane in the transverse direction.

17. The electrical connector assembly as claimed in claim 15, wherein each of the second contacts defines the contacting section in a vertical plane and the tail section in a horizontal plane perpendicular to each other.

18. The electrical connector assembly as claimed in claim 15, wherein there are three first contacts, and the tail section of a middle one is grouped with those of the second contacts, and the tail sections of two outer ones are grouped with those of the third contacts.

* * * * *